US010951012B2

(12) United States Patent
Sugiura

(10) Patent No.: US 10,951,012 B2
(45) Date of Patent: Mar. 16, 2021

(54) SPARK PLUG FOR INTERNAL COMBUSTION ENGINES AND INTERNAL COMBUSTION ENGINE

(71) Applicant: DENSO CORPORATION, Kariya (JP)

(72) Inventor: Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/924,779

(22) Filed: Jul. 9, 2020

(65) Prior Publication Data

US 2020/0343696 A1 Oct. 29, 2020

Related U.S. Application Data

(63) Continuation of application No. PCT/JP2018/047424, filed on Dec. 25, 2018.

(30) Foreign Application Priority Data

Jan. 12, 2018 (JP) ..... JP2018-003720

(51) Int. Cl.
*H01T 13/52* (2006.01)
*H01T 13/32* (2006.01)

(52) U.S. Cl.
CPC ..... *H01T 13/32* (2013.01); *H01T 13/52* (2013.01)

(58) Field of Classification Search
CPC ..... H01T 13/32; H01T 13/52; H01T 13/08; F02P 13/00
See application file for complete search history.

(56) References Cited

U.S. PATENT DOCUMENTS

2008/0092839 A1* 4/2008 Hanashi ..... H01T 13/18 123/169 R
2008/0314354 A1 12/2008 Yorita et al.
2010/0320893 A1 12/2010 Kato
2012/0299458 A1 11/2012 Aochi et al.
2014/0009058 A1 1/2014 Hwang et al.
2016/0072259 A1 3/2016 Kinoshita et al.
2017/0234287 A1 8/2017 Masuda et al.

FOREIGN PATENT DOCUMENTS

JP 2010-238377 10/2010
JP 2014-035853 2/2014
JP 2017-147086 8/2017

* cited by examiner

*Primary Examiner* — Donald L Raleigh
(74) *Attorney, Agent, or Firm* — Nixon & Vanderhye PC

(57) ABSTRACT

A spark plug has a specific direction orthogonal to an axial direction of a spark plug; the specific direction has opposing front directional side and rear directional side; the housing has a tip surface having a front end in the front side of the specific direction and a rear end in the rear side, the tip surface has a tip inclined surface inclined toward the tip end of the spark plug from the front end to the rear end of the tip surface. The tip inclined surface has a rear end in the specific direction, the insulator having a front end of the specific direction, the rear end is located to be closer to the tip end of the spark plug than the front end of the tip surface is, and to be more rearward than the front end of the insulator in the rear side of the specific direction.

12 Claims, 17 Drawing Sheets

SPARK PLUG FOR INTERNAL COMBUSTION ENGINES AND INTERNAL COMBUSTION ENGINE

CROSS-REFERENCE TO RELATED APPLICATION

The present application is a continuation application of International Application No. PCT/JP2018/047424, filed on Dec. 25, 2018, which claims priority to Japanese Patent Application No. 2018-003720, filed on Jan. 12, 2018. The contents of these applications are incorporated herein by reference in their entirety.

BACKGROUND

Technical Field

The present disclosure relates to a spark plug for internal combustion engines and an internal combustion engine including the spark plug.

Background Art

In the prior art, a spark plug is attached to the combustion chamber of an internal combustion engine in such a manner that the tip of the spark plug protrudes therein. A discharge generated by the spark plug ignites the fuel-air mixture in the combustion chamber.

SUMMARY

In the present disclosure, provided is a spark plug as the following. The spark plug includes a tubular housing, a tubular insulator, a central electrode, and a ground electrode. The spark plug has a specific direction that is orthogonal to the axial direction of the spark plug. The specific direction has opposing first and second sides, the first and second sides being respectively defined as a front directional side F and a rear directional side. The housing has a tip surface that has a front end in the front side of the specific direction and a rear end in the rear side of the specific direction, the tip surface having a tip inclined surface that is inclined toward the tip end of the spark plug from the front end to the rear end of the tip surface. The tip inclined surface has a rear end in the rear side of the specific direction, the insulator having a front end 3F in the front side of the specific direction, the rear end of the tip inclined surface being located to be closer to the tip end of the spark plug than the front end of the tip surface is, and being located to be more rearward than the front end of the insulator in the rear side of the specific direction.

BRIEF DESCRIPTION OF THE DRAWINGS

The above-described object and other objects as well as the characteristics and advantages of the present disclosure will be further clarified by the following detailed description with reference to the accompanying drawings. The drawings are as follows.

DETAILED DESCRIPTION OF THE PREFERRED EMBODIMENTS

[PTL 1] JP 2016-58196 A

Figure 1:
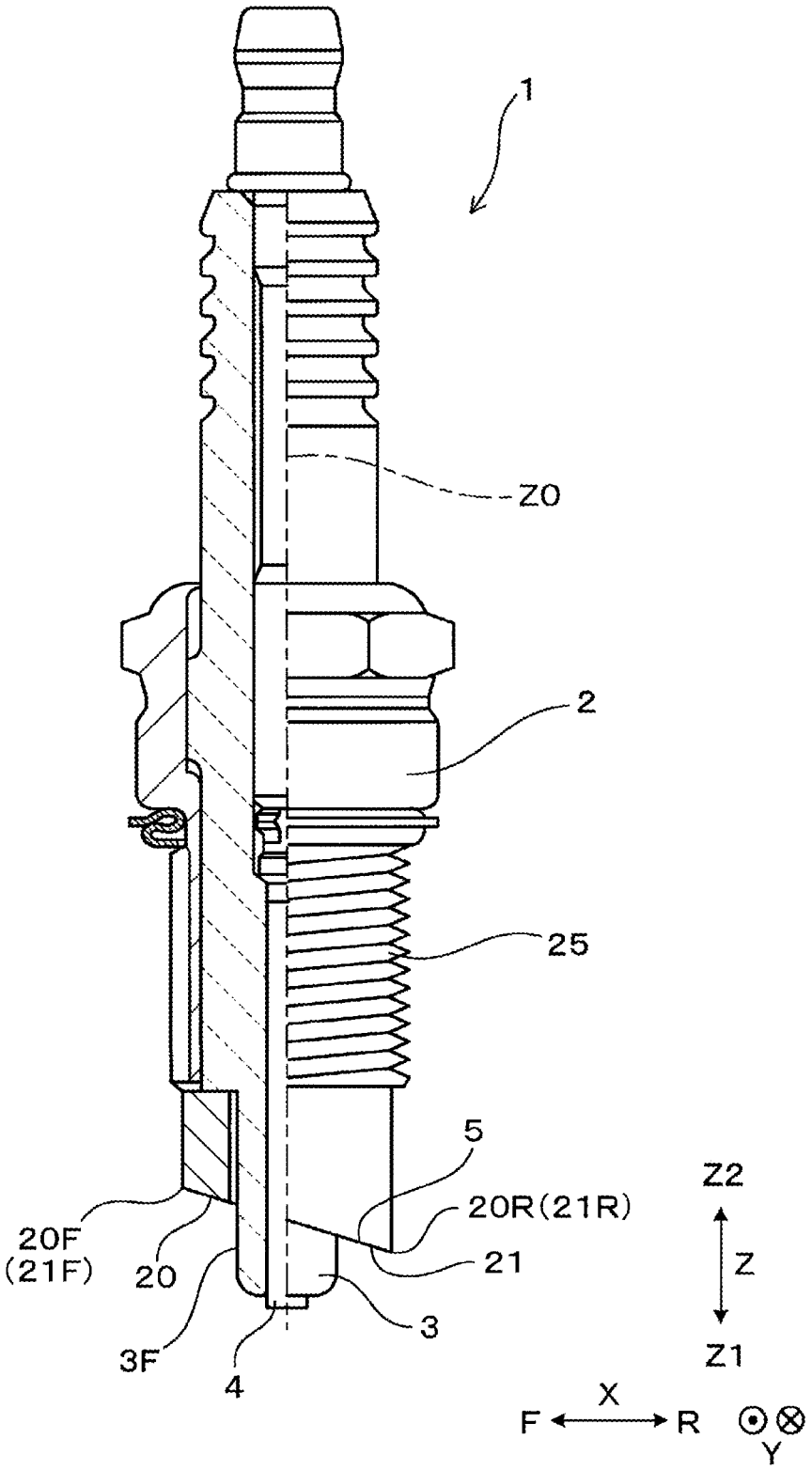
FIG. 1 is a partial cross-sectional front view of a spark plug in a first embodiment.

Spark plugs for internal combustion engines disclosed in PTL 1 have the following object.

That is, a discharge generated by a spark plug flows due to the air stream in a combustion chamber and is stretched. At this time, there is a risk that when a part of the discharge or the initial flame generated by the discharge comes in proximity or contact with the inner wall surface of the combustion chamber, the growth of the flame may be inhibited. As a result, there is a risk that the improvement of ignitability may become difficult.

Especially, there is a risk that the improvement of the ignitability during lean combustion may become difficult, which inhibits the improvement of a lean limit and the improvement of EGR (abbreviation for exhaust gas recirculation) limit. As a result, there is a risk that the improvement of fuel consumption may become difficult.

The present disclosure is to provide a spark plug for internal combustion engines and an internal combustion engine which improve ignitability.

An aspect of the present disclosure is a spark plug, having a tip end Z1 in an axial direction Z thereof, for an internal combustion engines, including:

a tubular housing;

a tubular insulator that has a tip and that is retained inside the housing;

a central electrode that has an end portion and that is retained inside the insulator, the end portion of the central electrode being exposed from the tip of the insulator toward the tip end of the spark plug; and a ground electrode that enables a discharge to be generated between the ground electrode and the central electrode, wherein the spark plug has a specific direction that is orthogonal to the axial direction of the spark plug;

the specific direction has opposing first and second sides, the first and second sides being respectively defined as a front directional side F and a rear directional side;

the housing has a tip surface that has a front end in the front side of the specific direction and a rear end in the rear side of the specific direction, the tip surface having a tip inclined surface that is inclined toward the tip end of the spark plug from the front end to the rear end of the tip surface; and the tip inclined surface has a rear end in the rear side of the specific direction, the insulator having a front end 3F in the front side of the specific direction, the rear end of the tip inclined surface being located to be closer to the tip end of the spark plug than the front end of the tip surface is, and being located to be more rearward than the front end of the insulator in the rear side of the specific direction.

Another aspect of the present disclosure is an internal combustion engine including a combustion chamber and the above-described spark plug for internal combustion engines, in which the spark plug has a front side portion in the front side of the specific direction, and the spark plug is disposed such that the front side portion of the spark plug faces an upstream side of an air stream in the combustion chamber.

In the spark plug, the tip surface of the housing has the tip inclined surface. The rear end of the tip inclined surface is closer to the tip side than the front end of the tip surface is and closer to the rear side than the front end of the insulator. Therefore, when the spark plug is attached to an internal combustion engine in such a posture that the front side faces the upstream side of the air stream, the tip inclined surface can direct the air stream in the vicinity of the discharge portion in the spark plug toward the tip side. This allows the discharge to be stretched in such a manner as to move away from the inner wall of the combustion chamber. As a result, the discharge and the initial flame can be prevented from being affected by cooling losses, and thus the growth of the flame can be promoted. As a result, Limitability can be improved.

As described above, according to the above-described aspects, there can be provided a spark plug for internal combustion engines and an internal combustion engine which improve ignitability.

First Embodiment

An embodiment of the spark plug for internal combustion engines and the internal combustion engine using this spark plug will be described with reference to FIG. 1 to FIG. 7.

A spark plug 1 for internal combustion engines of the present embodiment includes, as shown in FIG. 1 to FIG. 5, a tubular housing 2, a tubular insulator 3, a central electrode 4, and a ground electrode 5.

Figure 6:
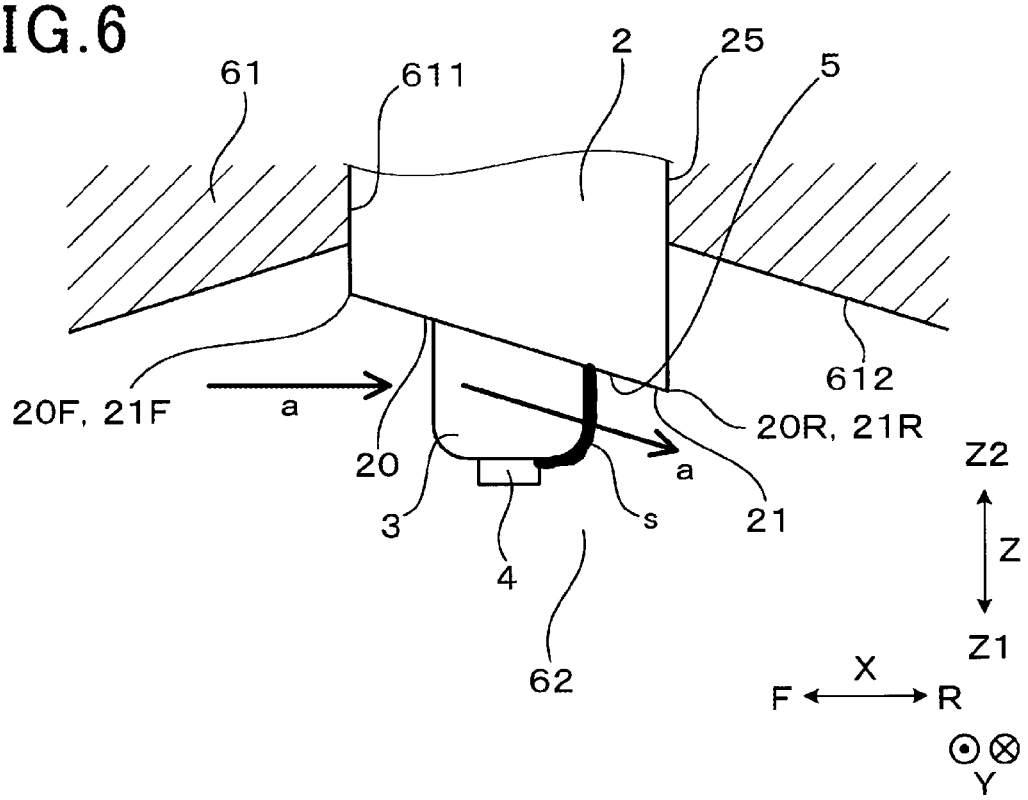
FIG. 6 is a view illustrating an internal combustion engine to which the spark plug is attached in the first embodiment.

The insulator 3 is retained inside the housing 2. The central electrode 4 is retained inside the insulator 3 and projects closer to a tip end Z11 than the tip of the insulator 3 does. The ground electrode 5 is, as shown in FIG. 6, configured to generate a discharge S between the ground electrode 5 and the central electrode 4.

The spark plug has a specific direction x that is orthogonal to the axial direction Z of the spark plug, the specific direction has opposing first and second sides, the first and second sides being respectively defined as a front directional side F and a rear directional side R. The housing 2 has a tip surface 20 that has a front end 20F in the front side of the specific direction and a rear end 20R in the rear side of the specific direction, the tip surface 20 has a tip inclined surface 21 that is inclined toward the tip end Z1 of the spark plug from the front end 20F to the rear end 20R of the tip surface. The tip inclined surface 21 has a rear end 21R in the rear side of the specific direction, the insulator 3 has a front end 3F in the front side of the specific direction, the rear end 21R of the tip inclined surface 21 is located to be closer to the tip end Z1 of the spark plug than the front end 20F of the tip surface 20 is, and is located to be more rearward R than the front end 3F of the insulator 3 in the rear side of the specific direction.

The spark plug 1 can be used as, for example, an igniter in internal combustion engines for vehicles such as automobile. In the spark plug 1 for internal combustion engines, a side at which the spark plug 1 is inserted into a combustion chamber is defined as the tip end Z11, and the opposite side is defined as a base end side Z2. As described herein, the plug axial direction Z denotes the axial direction of the spark plug 1. and a plug radial direction denotes the radial direction of the spark plug 1.

Also, a direction orthogonal to both the specific direction X and the plug axial direction Z is defined as a transverse direction Y. It is noted that the specific direction X is a direction orthogonal to the plug axial direction Z and also a direction in which the tip inclined surface 21 is inclined. When the direction of the tip inclined surface 21 is not constant, a direction in which the tip inclined surface 21 is inclined as a whole is defined as the specific direction X.

The front end 3F of the insulator 3 may be a site corresponding to the front end of an exposed portion of the insulator 3 from the housing 2.

In the spark plug 1 of the present embodiment, a part of the housing 2 functions as the ground electrode 5. That is, the tip surface 20 of the housing 2 also acts as the ground electrode 5. The insulator has an outer surface, as shown in FIG. 6, the spark plug is configured to enable a surface discharge to be generated along a part of the outer surface of the insulator 3 located between the central electrode 4 and the ground electrode 5. The spark plug 1 is configured to generate a discharge S between the ground electrode 5 and the central electrode 4 when high voltage is applied to the central electrode 4.

Figure 2:
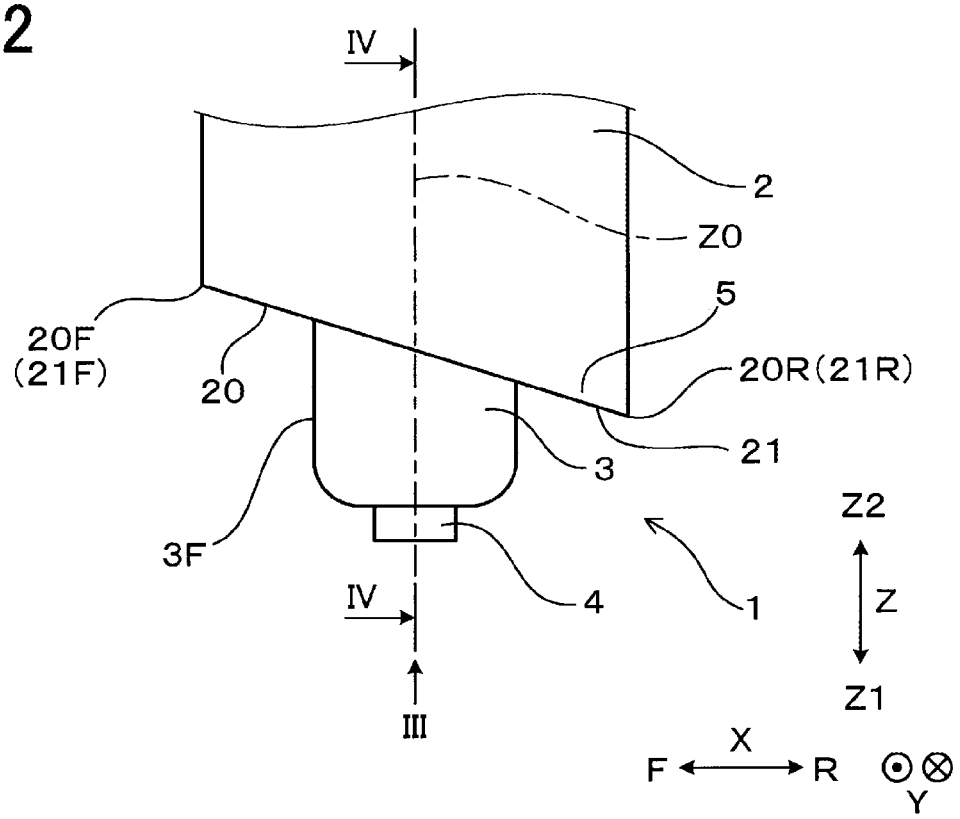
FIG. 2 is a front view of the tip portion of the spark plug in the first embodiment.
Figure 3:
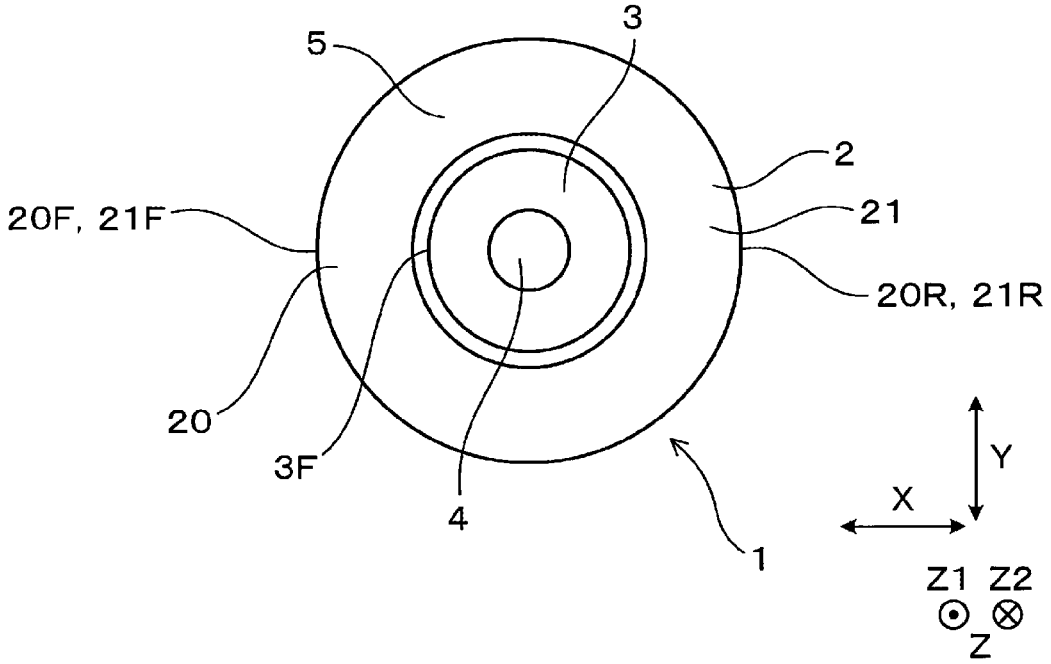
FIG. 3 is a view as seen from arrow III of FIG. 2.
Figure 4:
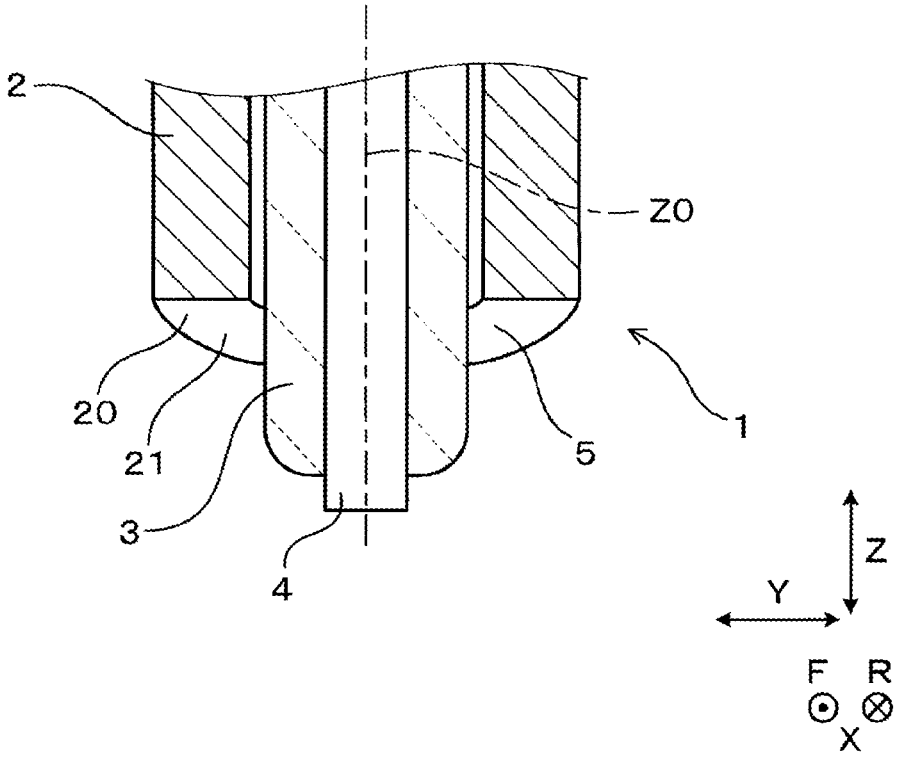
FIG. 4 is a cross-sectional view taken along arrow IV-IV of FIG. 2.

As shown in FIG. 2 and FIG. 3, the inner diameter of the housing 2 is somewhat larger than the outer shape of the insulator 3. A gap between the outer circumferential surface of the insulator 3 and the inner circumferential surface of the housing 2 is, for example, about 1 mm or less in the plug radial direction. It is noted that the outer circumferential surface of the insulator 3 and the inner circumferential surface of the housing 2 may be in contact with each other.

The tubular housing 2 has, on its outer peripheral surface, a mounting screw portion 25 to be screwed into an engine head. The housing 2 includes the ground electrode 5 at the tip end Z11 of the mounting screw portion 25. The ground electrode 5 has an annular shape in such a manner as to surround the entire circumference of the insulator 3. Furthermore, the tip inclined surface 21 is formed on the tip surface 20 of the housing 2 which also acts as the ground electrode 5.

As shown in FIG. 2, the spark plug has a central axis Z0, at least a part of the tip inclined surface 21 is located to be more rearward R than the central axis Z0 in the rear side of the specific direction. The rear end 21R of the tip inclined surface 21 constitutes a rear end 20R of the tip surface 20 of the housing 2 in the rear side of the specific direction. The tip inclined surface 21 is arranged astride a first region and a second region of the spark plug, the first region is more frontward F than the central axis Z0 of the spark plug, the second region is more rearward R than the central axis of the spark plug. The tip inclined surface 21 is formed to extend from the front end 20F to the rear end 21R on the tip surface 20 of the housing 2.

Figure 5:
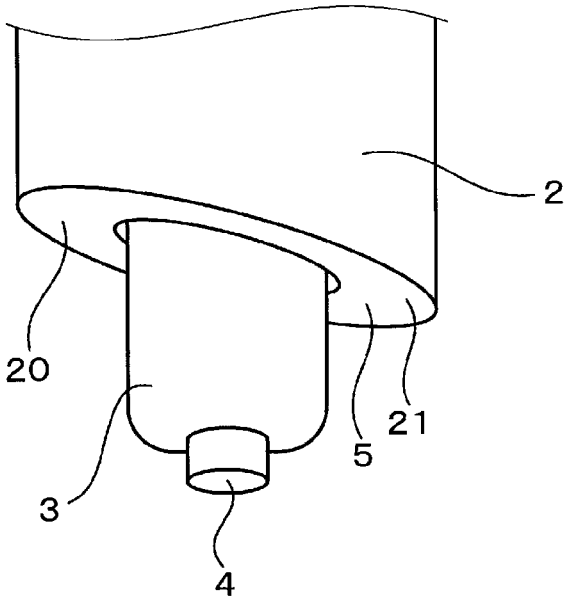
FIG. 5 is a perspective view of the tip portion of the spark plug in the first embodiment.

As shown in FIG. 2, FIG. 3, and FIG. 5, the tip inclined surface 21 is formed entirely on the tip surface 20 of the housing 2. In the present embodiment, the tip inclined surface 21 is a flat surface.

Figure 7:
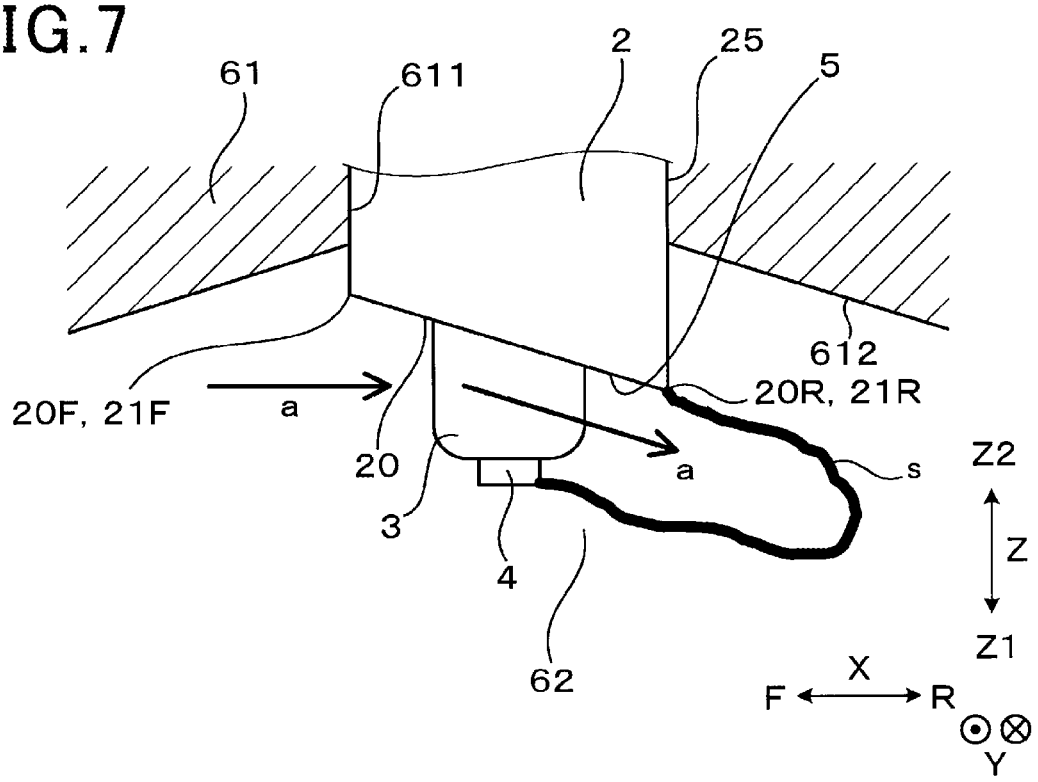
FIG. 7 is a view of the internal combustion engine illustrating a state in which a discharge is stretched, in the first embodiment.
Figure 8:
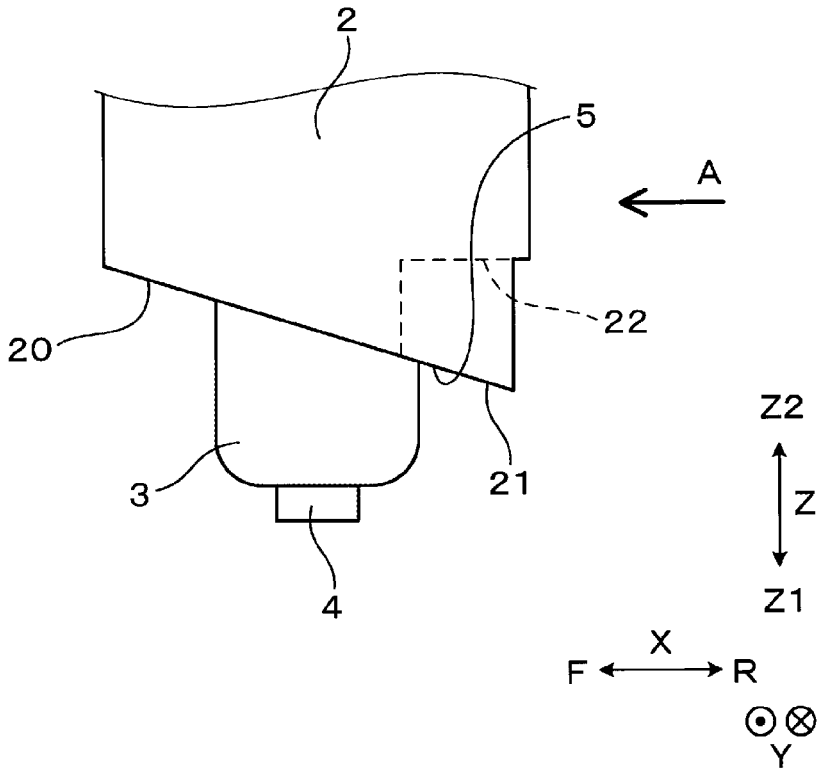
FIG. 8 is a front view of a tip portion of a spark plug in a second embodiment.
Figure 9:
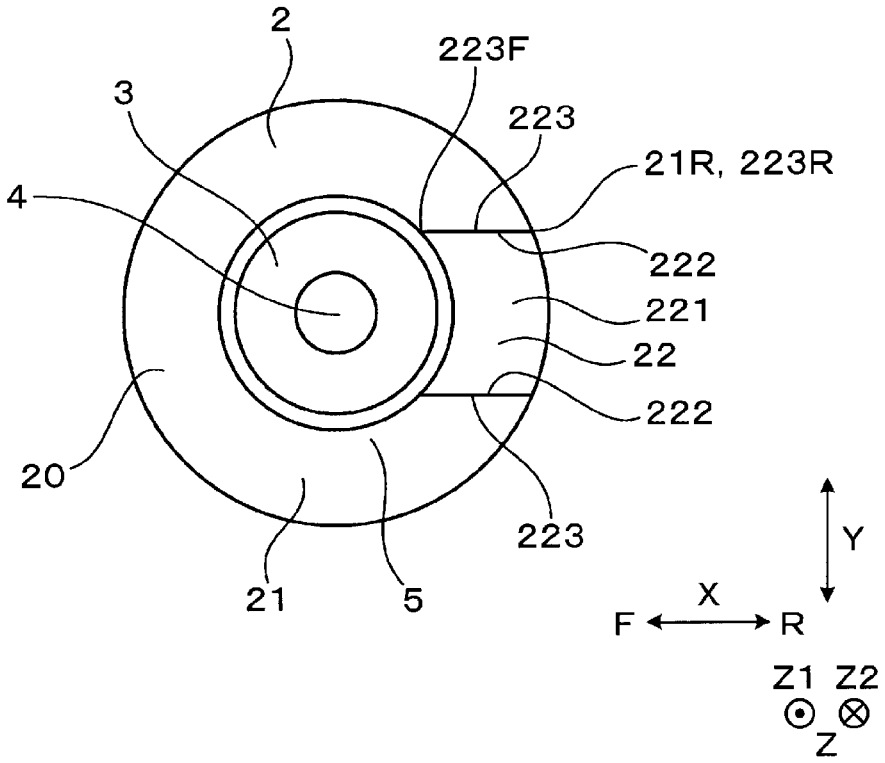
FIG. 9 is a front view of the spark plug as seen from a tip side in the second embodiment.
Figure 10:
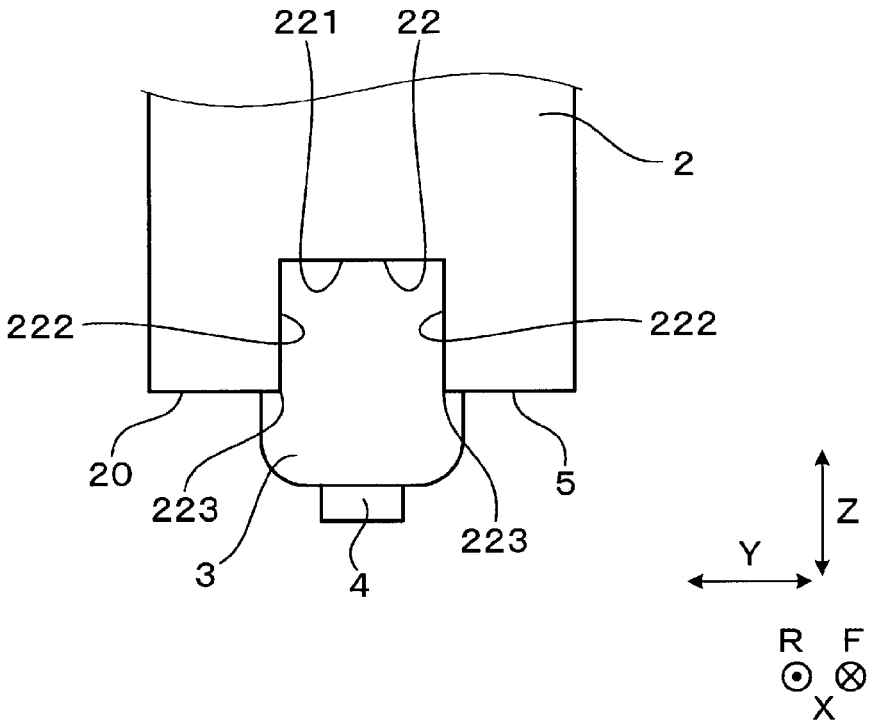
FIG. 10 is a view as seen from arrow A of FIG. 8.

Next, the internal combustion engine including the spark plug 1 will be described with reference to FIG. 6 and FIG. 7.

The spark plug 1 is disposed such that the front side F of the spark plug 1 faces the upstream side of an air stream A in a combustion chamber 62.

The spark plug 1 is attached to a plug hole 611 of an engine head 61. That is, the mounting screw portion 25 is screwed into a female screw formed on the inner circumferential surface of the plug hole 611, so that the spark plug 1 is attached to the engine head 61. The tip portion of the spark plug 1 protrudes into the combustion chamber 62. Around the tip portion of the spark plug 1, a base end-side wall surface 612 exists. This base end-side wall surface 612 gradually inclines toward the tip end Z11 with distance in the plug radial direction from the spark plug 1. In the present embodiment, the entirety of the tip surface 20 of the housing 2 protrudes into the combustion chamber 62. However, for example, the front end 21F of the tip inclined surface 21 may coincide with the tip of the plug hole 611 or may be disposed somewhat closer to the base end side than the tip of the plug hole 611.

In the combustion chamber 62, the air stream A occurs in the vicinity of the tip portion of the spark plug 1. That is, while the internal combustion engine operates, the air stream A flows from a direction substantially orthogonal to the plug axial direction Z toward the vicinity of the tip portion of the spark plug 1.

Meanwhile, in the spark plug 1, a prescribed voltage is applied to the central electrode 4 so that, as shown in FIG. 6, a discharge S is generated between the central electrode 4 and the ground electrode 5. This discharge S acts as a surface discharge along the surface of the insulator 3 between the central electrode 4 and the ground electrode 5.

This discharge S is stretched by the above-described air stream A. In brief, as shown in FIG. 7, the discharge S is pulled away from the surface of the insulator 3 and stretched in the combustion chamber 62. The stretched discharge S ignites the fuel-air mixture in the combustion chamber 62. Accordingly, a flame occurs and spreads, causing combustion in the combustion chamber 62.

As described above, the spark plug 1 is attached to the internal combustion engine in such a posture that the front side F faces the upstream side of the air stream A. In brief, the front end 20F of the tip surface 20 of the housing 2 is positioned closer to the upstream side of the air stream A than the rear end 20R. Therefore, the tip inclined surface 21 formed on the tip surface 20 inclines toward the tip end Z11 in the plug axial direction Z from the upstream side to the downstream side of the air stream A. Therefore, the air stream A in the vicinity of the tip portion of the spark plug 1 is guided by the tip inclined surface 21 to modify its path toward the tip end Z11 of the combustion chamber 62, that is, toward a direction away from the base end-side wall surface 612.

In association with this, the discharge S stretched by the air stream A also spreads toward the tip end Z11 of the combustion chamber 62, that is, toward a direction away from the base end-side wall surface 612. Accordingly, this suppresses the discharge S from contacting or being adjacent to the base end-side wall surface 612, thus reducing a cooling loss due to the disappearance of the discharge S. Furthermore, a cooling loss, in which the initial flame ignited by the discharge S disappears when it comes into contact or proximity with the base end-side wall surface 612, can be suppressed. Therefore, the growth of the flame is unlikely to be inhibited, and ignitability can be improved. For example, the ignitability of lean combustion can be improved. As a result, fuel consumption can also be improved.

In the above-described spark plug 1, the tip surface 20 of the housing 2 has the tip inclined surface 21 formed as described above. Therefore, when the spark plug 1 is attached to the internal combustion engine in such a posture that the front side F is the upstream side of the air stream A as described above, the tip inclined surface 21 can direct the air stream A in the vicinity of the discharge portion in the spark plug 1 toward the tip end Z11. This allows the discharge S to be stretched in such a manner as to move away from the base end-side wall surface 612 of the combustion chamber 62. As a result, the discharge S and the initial flame can be prevented from being affected by cooling losses, and the growth of the flame can be promoted. As a result, ignitability can be improved.

At least a part of the tip inclined surface 21 is formed in a region closer to the rear side R than the plug central axis Z0 on the tip surface 20. Accordingly, the air stream A in the region including the plug central axis Z0 is likely to be directed toward the tip end Z11. As a result, the discharge S is likely to be more reliably directed toward the tip end Z11.

The rear end 21R of the tip inclined surface 21 is the rear end 20R of the tip surface 20. That is, the tip inclined surface 21 extends to the rear end 20R of the tip surface 20. Therefore, the tip inclined surface 21 can be formed over a wide area in the specific direction X. Therefore, a larger amount of the air stream A is likely to be directed toward the tip end Z11. As a result, the discharge S is likely to be more effectively directed toward the tip end Z11.

The tip inclined surface 21 is formed astride a region closer to the front side F and a region closer to the rear side R than the plug central axis Z0. Accordingly, the air stream A is likely to be reliably directed toward the tip end Z11 in the vicinity of the discharge portion.

The tip inclined surface 21 is formed from the front end 20F to the rear end 20R on the tip surface 20. Accordingly, the tip inclined surface 21 can be formed over a wide area in the specific direction X. As a result, a larger amount of the air stream A is likely to be directed toward the tip end Z11.

The tip inclined surface 21 is formed on the entire surface of the tip surface 20. Accordingly, the area of the tip inclined surface 21 can be increased as much as possible. As a result, a large amount of the air stream A is likely to be directed toward the tip end Z11 in a larger area.

It is configured that a surface discharge along the surface of the insulator 3 is generated between the central electrode 4 and the ground electrode 5. In such a discharge type spark plug 1, the inner diameter of the housing 2 is decreased such that the ground electrode 5 on the tip of the housing 2 and the outer circumferential surface of the insulator 3 are proximate to each other. This is likely to increase the area of the tip surface 20 of the housing 2. Therefore, the tip inclined surface 21 is likely to have a large area. As a result, the function of guiding the air stream A by the tip inclined surface 21 is likely to be exerted to a large extent, contributing to the improvement of ignitability.

Also, the spark plug 1 configured to cause a surface discharge has a relatively long distance in the plug axial direction Z between the ground electrode 5 and the central electrode 4 to serve as the starting point of the discharge S. Therefore, when the discharge S is stretched by the air stream A, the discharge S is likely to come into proximity with the base end-side wall surface 612 of the combustion chamber 62, which is likely to increase the demand for directing the stretched direction of the discharge S toward the tip end Z11. To address this concern, the configuration of the present embodiment is adopted such that the discharge S is likely to be directed toward the tip end Z11, thereby effectively improving ignitability.

As described above, according to the present embodiment, there can be provided a spark plug for internal combustion engines and an internal combustion engine which improve ignitability.

Second Embodiment

In the present embodiment, the insulator 3 has a rear end in the rear side of the specific direction, and the housing 2 has, as shown in FIG. 8 to FIG. 13, a notch portion 22 extends from the tip surface 20 toward the base end side Z2, at the rear side R of the insulator 3.

Thus, the tip inclined surface 21 is formed in a portion other than the notch portion 22 on the tip surface 20 of the housing 2.

The notch portion 22 is formed from the inside to the outside of the housing 2 in such a manlier as to extend through the plug radial direction. Also, a base bottom portion 221 of the notch portion 22 is formed in a position closer to the base end side Z2 than the front end 20F of the tip surface 20 of the housing 2. However, this position is not particularly limited.

A pair of inside surfaces 222 of the notch portion 22 face each other. In addition, the pair of inside surfaces 222 is substantially parallel to the specific direction X. A distance between the inside surfaces 222 in the notch portion 22 is larger than the diameter of the central electrode 4. At the tip ends of the inside surfaces 222, tip edges 223 are formed.

Except for the above-described configuration, the present embodiment is the same as the first embodiment. It is noted that the reference numerals used in the second embodiment and thereafter that are the same as those used in the previous embodiment denote the same constituents and the like as those in the previous embodiment, unless otherwise indicated.

Figure 11:
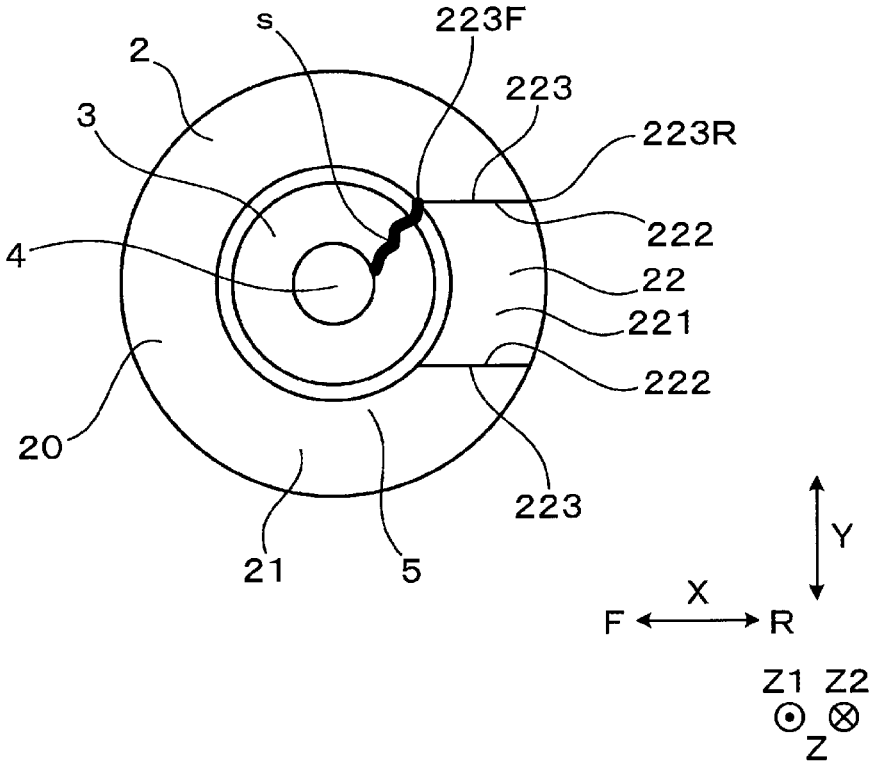
FIG. 11 is a plan view, as seen from the tip side, illustrating a state of the initial discharge in the second embodiment.
Figure 12:
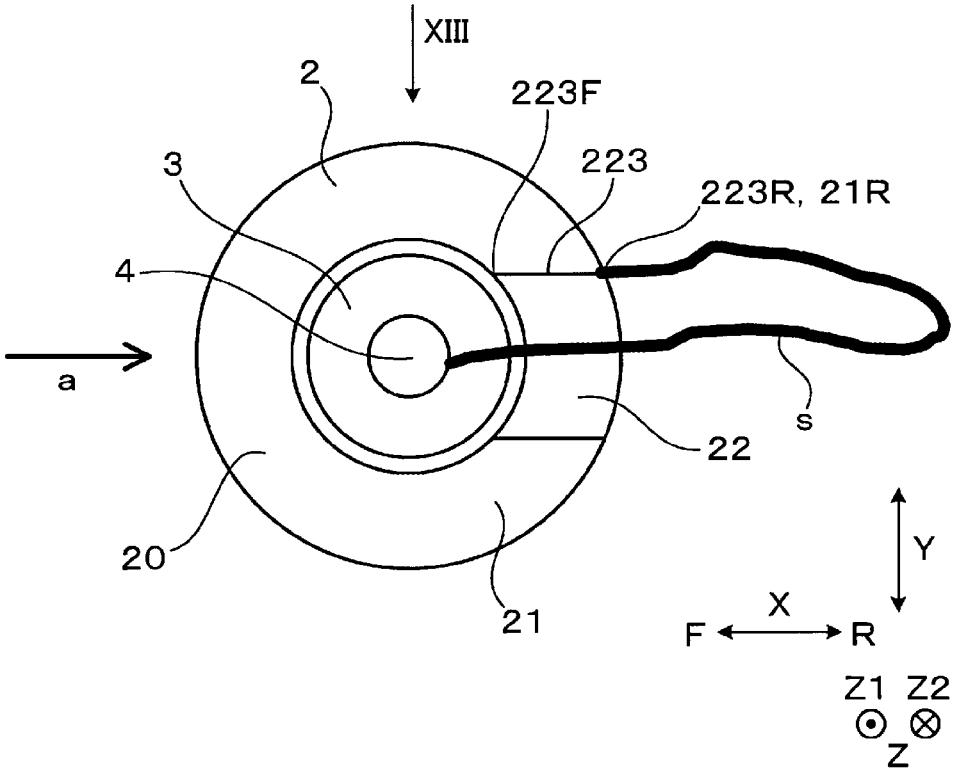
FIG. 12 is a plan view, as seen from the tip side, illustrating a state in which the discharge is stretched in the second embodiment.
Figure 13:
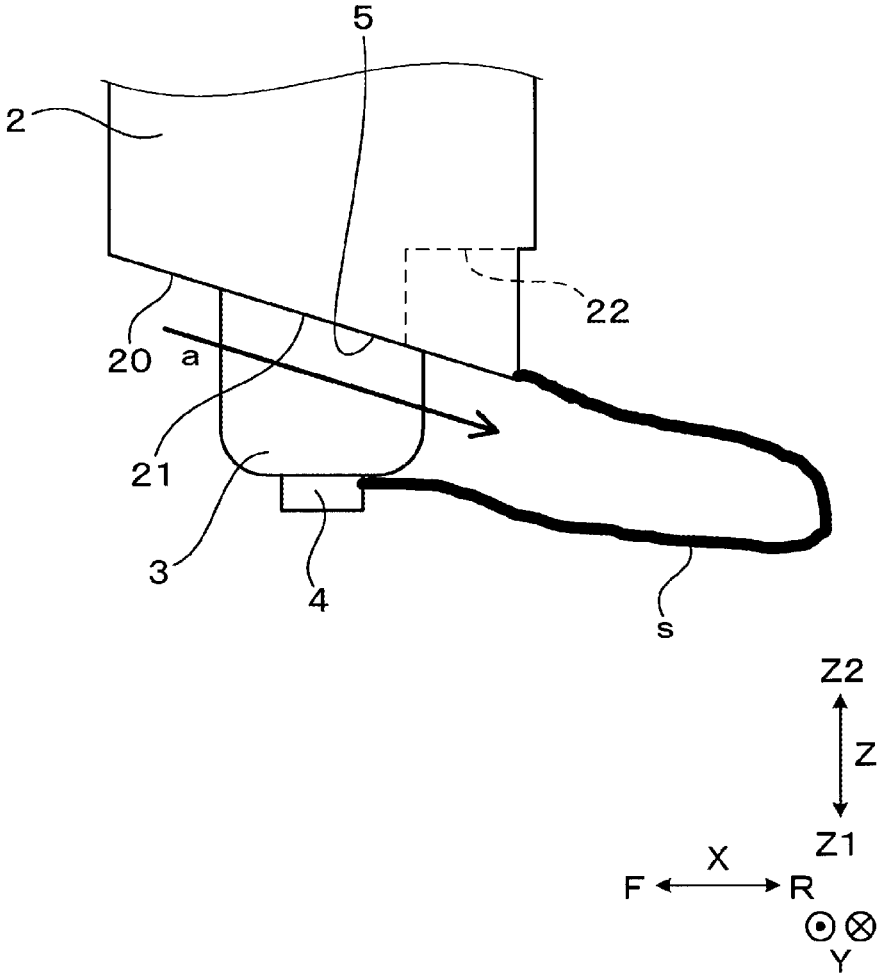
FIG. 13 is a view as seen from arrow XIII of FIG. 12.

In the spark plug 1 of the present embodiment, as shown in FIG. 11, the initial discharge S is mainly generated between the central electrode 4 and a front end 223F of the tip edge 223. While the discharge S is stretched by the air stream A, the starting point at the side of the ground electrode 5 moves from the front end 223F along the tip edge 223 to the rear side R. Then, as shown in FIG. 12, it reaches a rear end 223R of the tip edge 223. As shown in FIG. 12 and FIG. 13, the discharge S is further stretched toward the rear side R and the tip end Z11.

In the present embodiment, a discharge is formed at a position where it is likely to be stretched along the air stream A by the notch portion 22 , and at the same time, the air stream A is directed toward the tip end Z11 by the tip inclined surface 21. Also, one of the starting points of the discharge S can be smoothly moved to the rear side R by the tip edges 223 formed at the tip end Z11 of the notch portion 22. As a result, the discharge S can be smoothly stretched to the rear side R and the tip end Z11.

In addition to the above-described operation and effect, the present embodiment has the same operation and effect as in the first embodiment.

Third Embodiment

Figure 17:
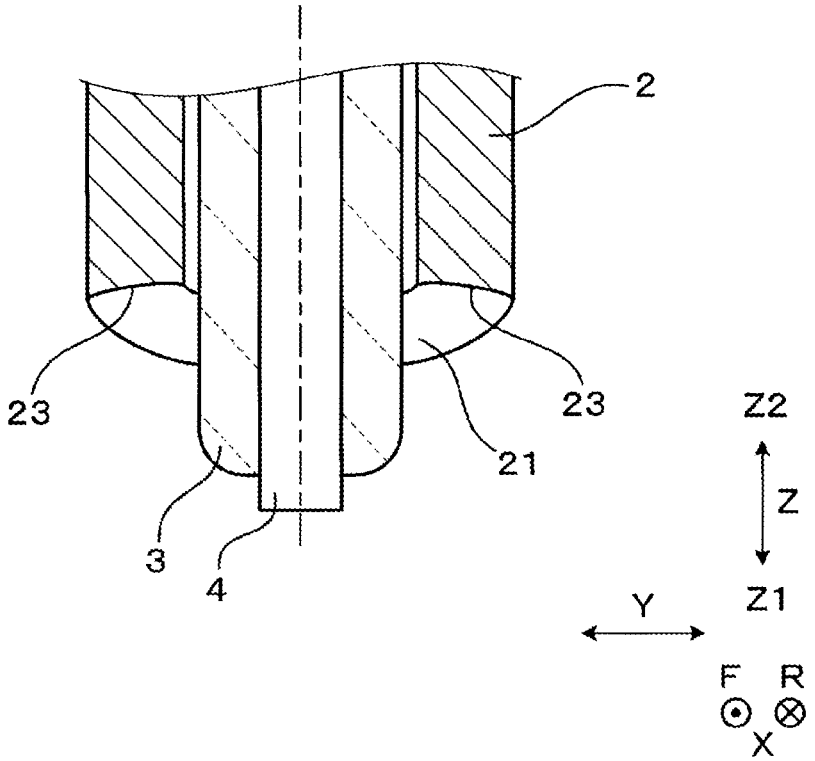
FIG. 17 is a cross-sectional view taken along arrow XVII-XVII of FIG. 14.

In the spark plug 1 of the present embodiment, as shown in FIG. 14 to FIG. 18, the tip surface 20 of the housing 2 has a radially inclined surface 23. The spark plug has a base end Z2 opposite to the tip end, a center axis, and an outer circumferential side, and the radially inclined surface 23 is inclined toward the base end side Z2 from the outer circumferential side toward the center side in the radial direction of the spark plug. In brief, unlike the spark plug 1 of the first embodiment (see FIG. 4), as shown in FIG. 17, the tip surface 20 of the housing 2 has a portion that also gradually inclines toward the base end side Z2 from the both ends to the center side in the transverse direction Y.

Figure 14:
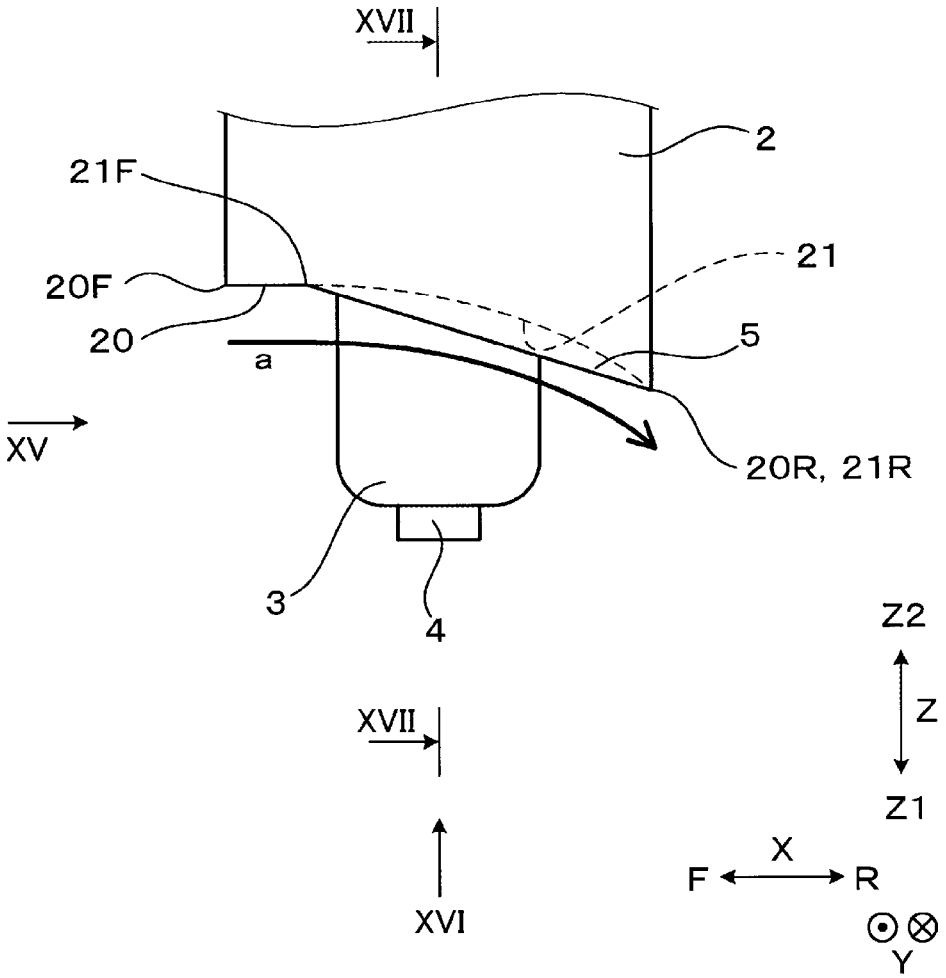
FIG. 14 is a front view of a tip portion of a spark plug in a third embodiment.
Figure 15:
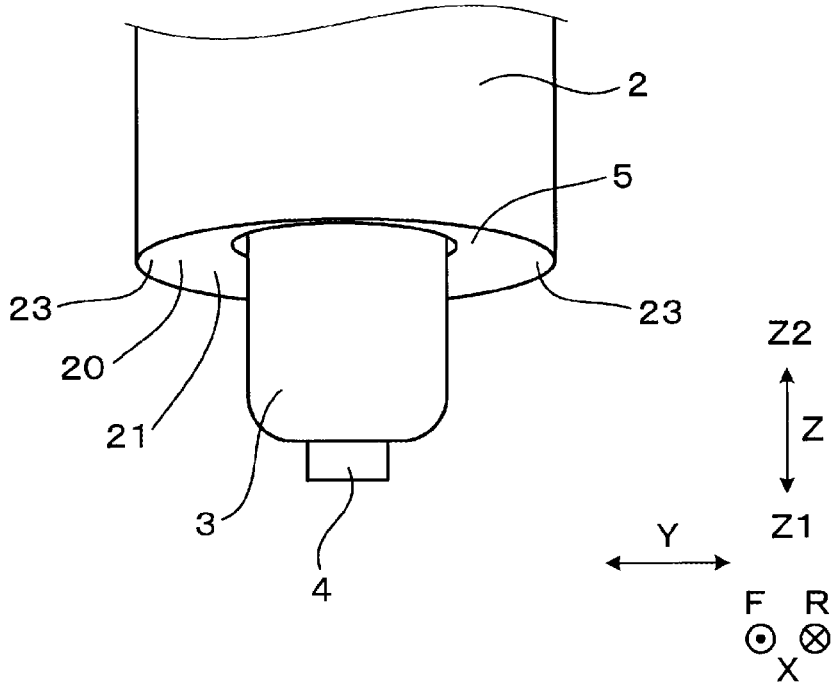
FIG. 15 is a view as seen from arrow XV of FIG. 14.
Figure 16:
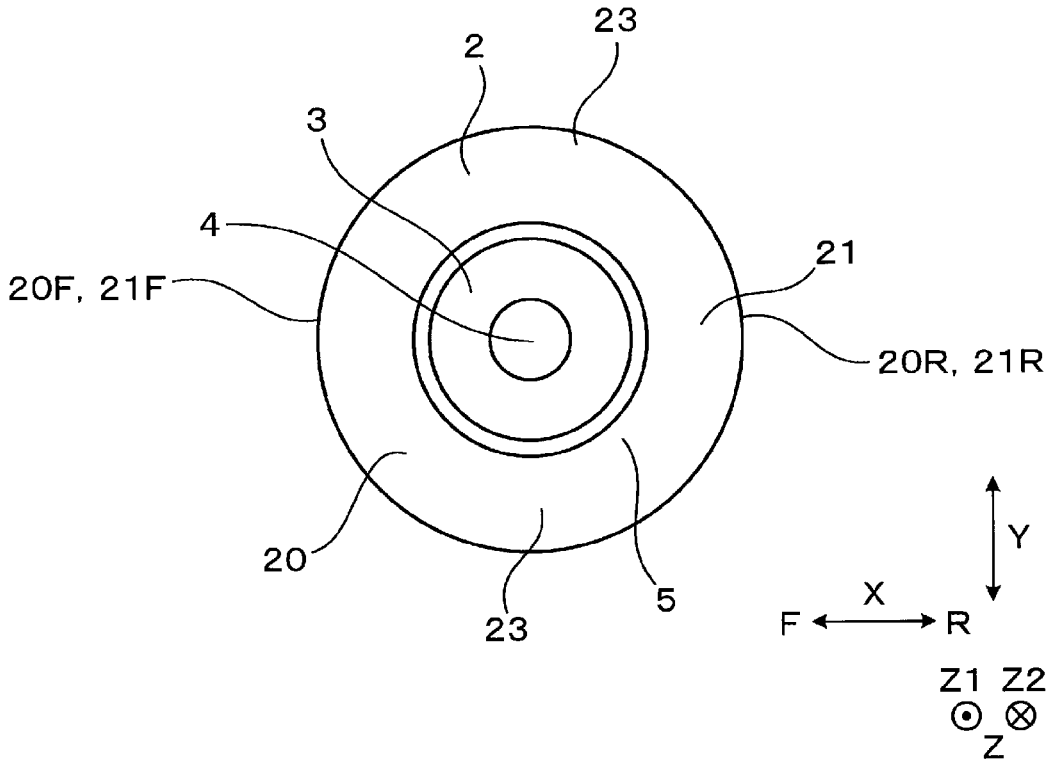
FIG. 16 is a view as seen from arrow XVI of FIG. 14.
Figure 18:
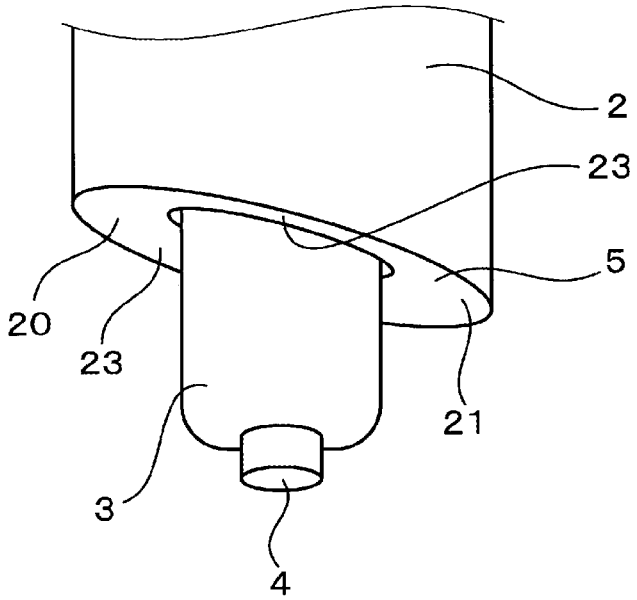
FIG. 18 is a perspective view illustrating the tip portion of the spark plug as seen from an oblique tip side in a transverse direction in the third embodiment.

Thus, as shown in FIG. 15 and FIG. 18, the tip inclined surface 21 comes to be formed on the radially inclined surface 23. In brief, the tip surface 20 has, as shown in FIG. 17, a concave shape in which in the transverse direction Y, the inner portion is recessed toward the base end side Z2 than the both edges. Also, in the specific direction X, the tip surface 20 gradually inclines toward the tip end Z11 from the front side F to the rear side R, as shown in FIG. 14. In this manner, the tip surface 20 constitutes the radially inclined surface 23 while also constituting the tip inclined surface 21.

Furthermore, in the present embodiment, the radially inclined surface 23 sinks toward the base end side Z2 in a curve shape, as shown in FIG. 14. Accordingly, the tip inclined surface 21 has a shape in which the rear portion forms a larger inclination angle to the specific direction X (plug radial direction), when seen from the transverse direction Y, than the front portion, as shown in FIG. 14. It is noted that the radially inclined surface 23 is not necessarily curbed, but may be, for example, constituted by a plurality of planar surfaces.

Except for the above-described configuration, the present embodiment is the same as the first embodiment.

In the present embodiment, the radially inclined surface 23 can modify the path of the air stream A toward the tip end Z11 while guiding the air stream A to the specific direction X. Accordingly, the air stream A can be further effectively directed to the center side of the combustion chamber 62.

Especially, the direction of the air stream A moving toward the vicinity of the tip portion of the spark plug 1 actually varies, and is not necessarily along the specific direction X when seen from the plug axial direction Z. Also, the posture of the spark plug 1 attached to the engine head 61 can vary. That is, when seen from the plug axial direction Z, there is a possibility that the air stream A may incline with respect to the specific direction X at as much as about 30 to 45°. Accordingly, the air stream A in a direction inclining with respect to the specific direction X when seen from the plug axial direction Z sometimes reaches the vicinity of the tip portion of the spark plug 1. In such a case, the radially inclined surface 23 can correct the varied direction of the air stream A so that the air stream A is guided in a direction along the specific direction X when seen from the plug axial direction Z.

At the same time, the tip inclined surface 21 can modify the path of the air stream A such that the air stream A is directed to the tip end Z11.

Accordingly, the air stream A can be further efficiently directed to the center side of the combustion chamber. As a result, ignitability can be further improved.

In addition to the above-described operation and effect, the present embodiment has the same operation and effect as in the first embodiment.

Fourth Embodiment

The present embodiment is, as shown in FIG. 19 to FIG. 24, an example of a spark plug 10 having a spark discharge gap G.

That is, in the spark plug 10 of the present embodiment, the central electrode 4 and the ground electrode 5 face each other with the spark discharge gap G disposed therebetween.

The spark plug 10 of this type generates a spark discharge in the spark discharge gap G when high voltage is applied to the central electrode 4.

Figure 19:
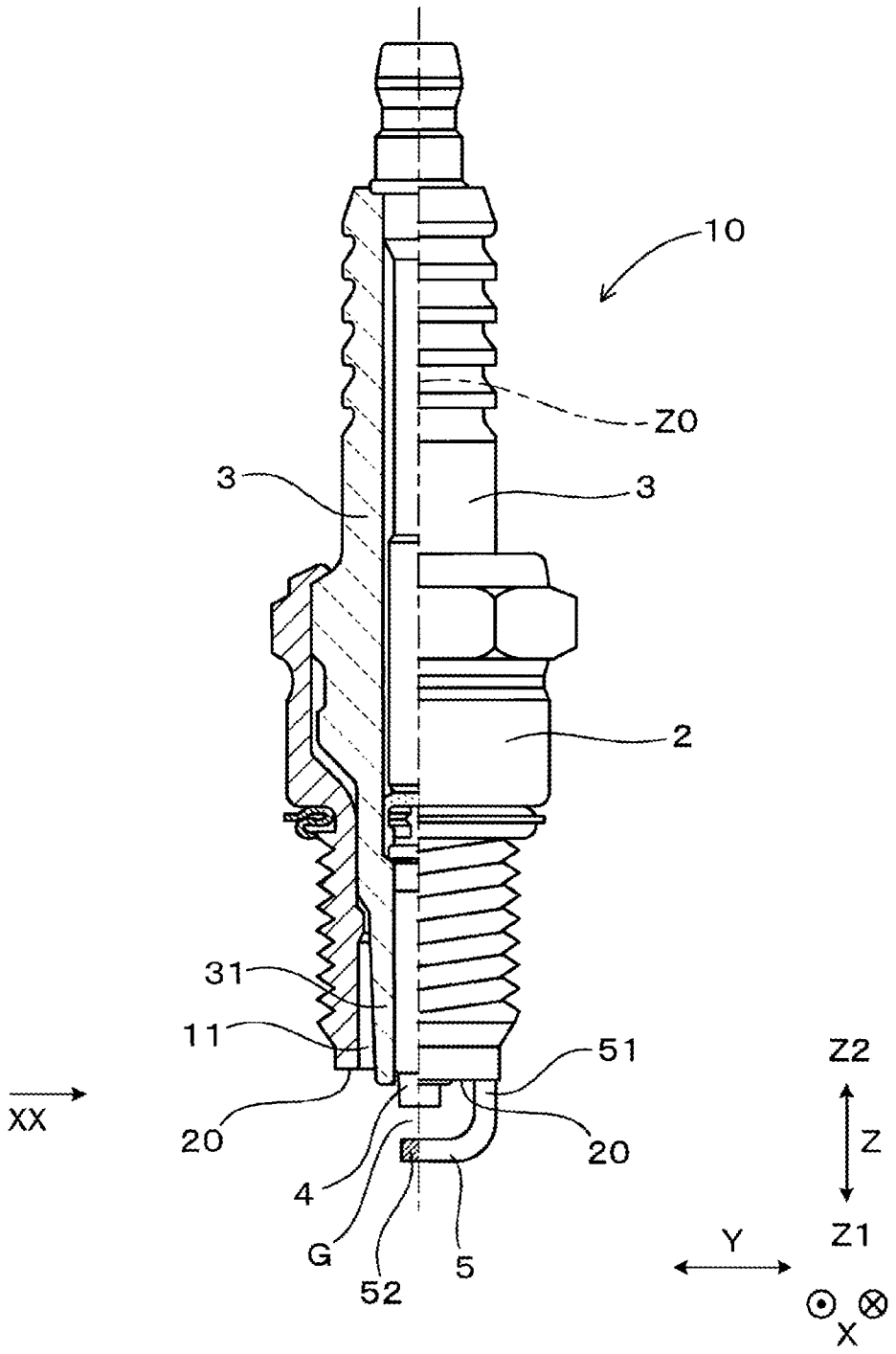
FIG. 19 is a partial cross-sectional side view of a spark plug in a fourth embodiment.
Figure 20:
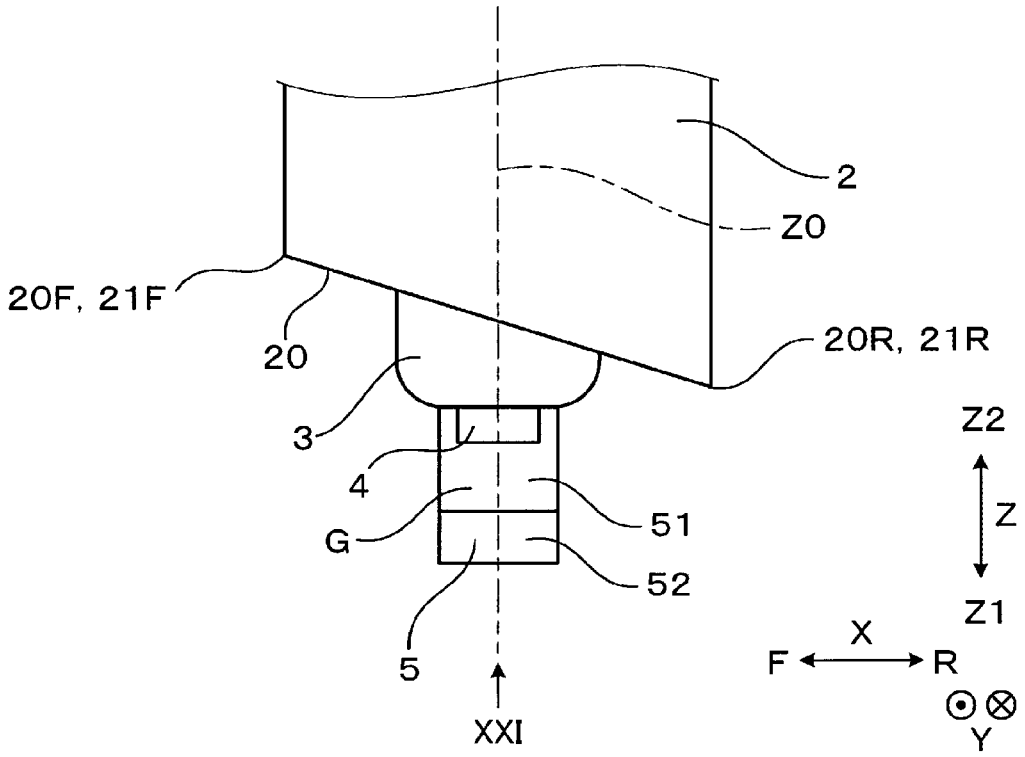
FIG. 20 is a front view of the tip portion of the spark plug in the fourth embodiment and a view as seen from arrow XX of FIG. 19.
Figure 21:
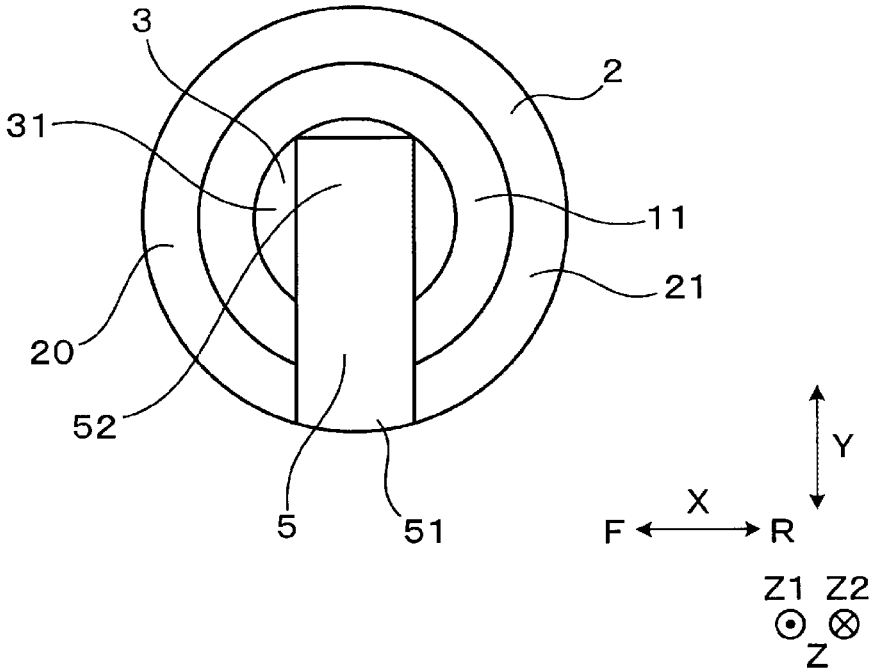
FIG. 21 is a view as seen from arrow XXI of FIG. 20.

The ground electrode 5 extends from the tip surface 20 of the housing 2 toward the tip end Z11 and bends toward the plug center side. Also, the ground electrode 5 and the central electrode 4 face each other in the plug axial direction Z. That is, the ground electrode 5 includes, as shown in FIG. 19 to FIG. 21, an protrusion portion 51 that protrudes from the tip surface 20 of the housing 2 toward the tip end Z11 and a facing portion 52 that bends from the tip of the protrusion portion 51 and faces the central electrode 4 in the plug axial direction Z.

The protrusion portion 51 faces the central electrode 4 in the transverse direction Y. The facing portion 52 extends in the transverse direction Y from the tip portion of the protrusion portion 51. Therefore, when seen from the plug axial direction Z, a direction orthogonal to the formed direction of the facing portion 52 comes to be the specific direction X. Furthermore, as shown in FIG. 20, the tip inclined surface 21 inclining in the specific direction X is formed on the tip surface 20 of the housing 2. In the present embodiment, the tip inclined surface 21 is formed on the entire surface of the tip surface 20.

A pocket portion 11 as a space opening to the tip end Z11 is formed at the outer circumferential side of a leg portion 31 as the tip portion of the insulator 3 and at the inner circumferential side of the housing 2. The pocket portion 11 has a ring shape. The tip portion of the pocket portion 11 has a width in the plug radial direction of about 1.5 to 2.5 mm.

Figure 22:
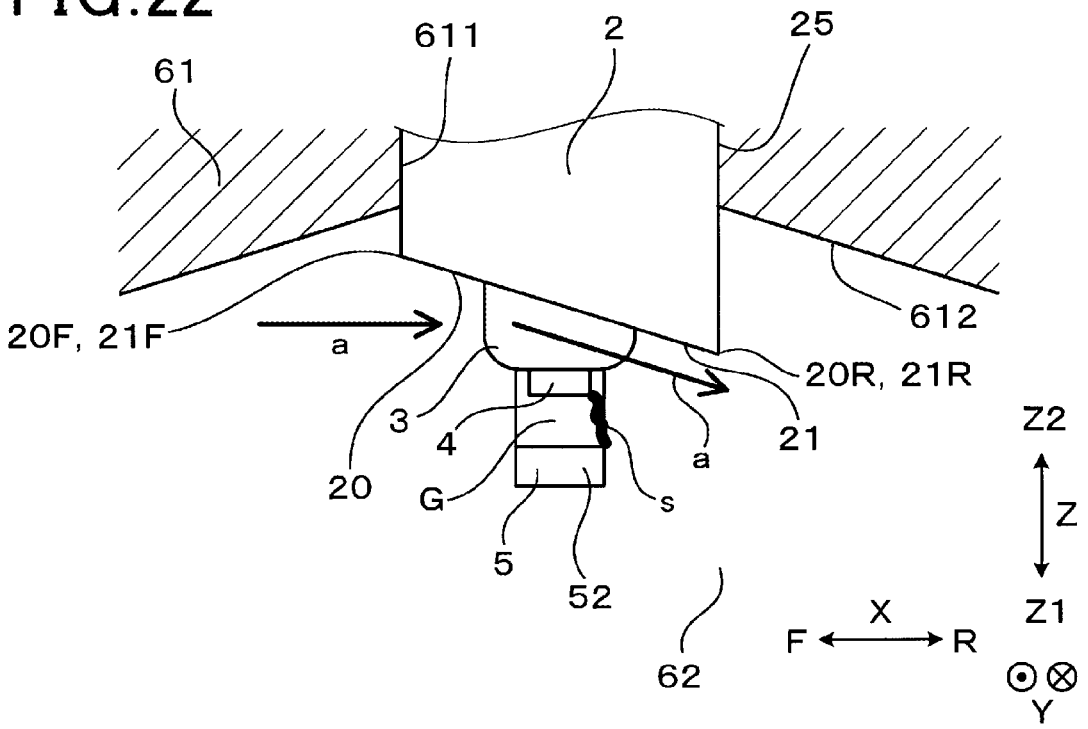
FIG. 22 is a view illustrating an internal combustion engine to which the spark plug is attached in the fourth embodiment.
Figure 23:
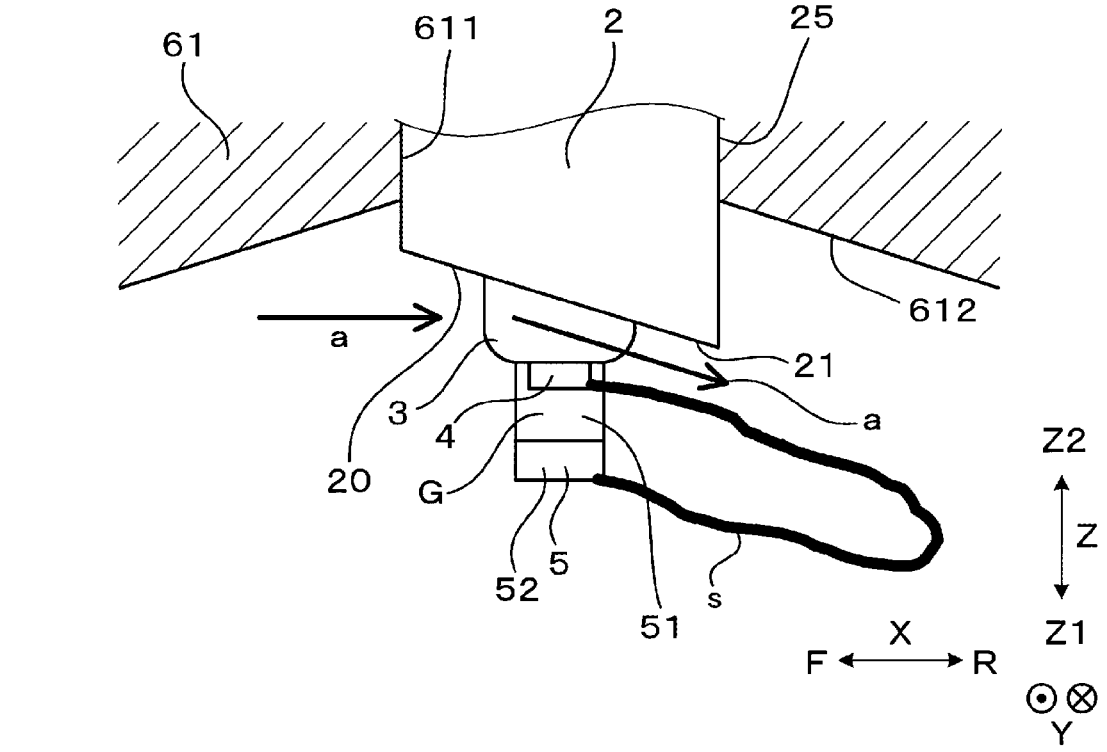
FIG. 23 is a view illustrating the internal combustion engine in a state in which a discharge is stretched in the fourth embodiment.

Next, the internal combustion engine including the spark plug 10 will be described with reference to FIG. 22 and FIG. 23.

The spark plug 10 has a front side portion in the front side of the specific direction, and the spark plug 10 is disposed such that the front side portion F of the spark plug 10 faces the upstream side of the air stream A in the combustion chamber 62. In this configuration, a direction in which the protrusion portion 51 of the ground electrode 5 and the central electrode 4 are aligned comes to be substantially orthogonal to the air stream A.

In the same manner as in the first embodiment, the tip portion of the spark plug 10 protrudes into the combustion chamber 62 in a state in which the spark plug 10 is attached to the plug hole 611 of the engine head 61. Also, in the present embodiment, the entirety of the tip surface 20 of the housing 2 protrudes into the combustion chamber 62. However, in the same manner as in the first embodiment, the entirety of the tip surface 20 may not necessarily protrude into the combustion chamber 62. Around the tip portion of the spark plug 10, a base end-side wall surface 612 exists.

In the combustion chamber 62, an air stream A occurs in the vicinity of the tip portion of the spark plug 10. In the spark plug 10, a discharge S is generated in the spark discharge gap G when a prescribed voltage is applied to the central electrode 4.

This discharge S is stretched by the above-described air stream A. As described above, the spark plug 10 is attached to the internal combustion engine in such a posture that the front side F faces the upstream side of the air stream A. Accordingly, the air stream A in the vicinity of the tip portion of the spark plug 1 is guided by the tip inclined surface 21 to modify its path in such a manner as to move toward the tip end Z11 of the combustion chamber 62, that is, toward a direction away from the base end-side wall surface 612.

In association with this, the discharge S stretched by the air stream A also spreads toward the tip end Z11 of the combustion chamber 62, that is, in a direction away from the base end-side wall surface 612. Accordingly, cooling losses can be suppressed to improve ignitability. In the present embodiment, for example, the ignitability of lean combustion can also be improved. As a result, fuel consumption can also be improved.

Figure 24:
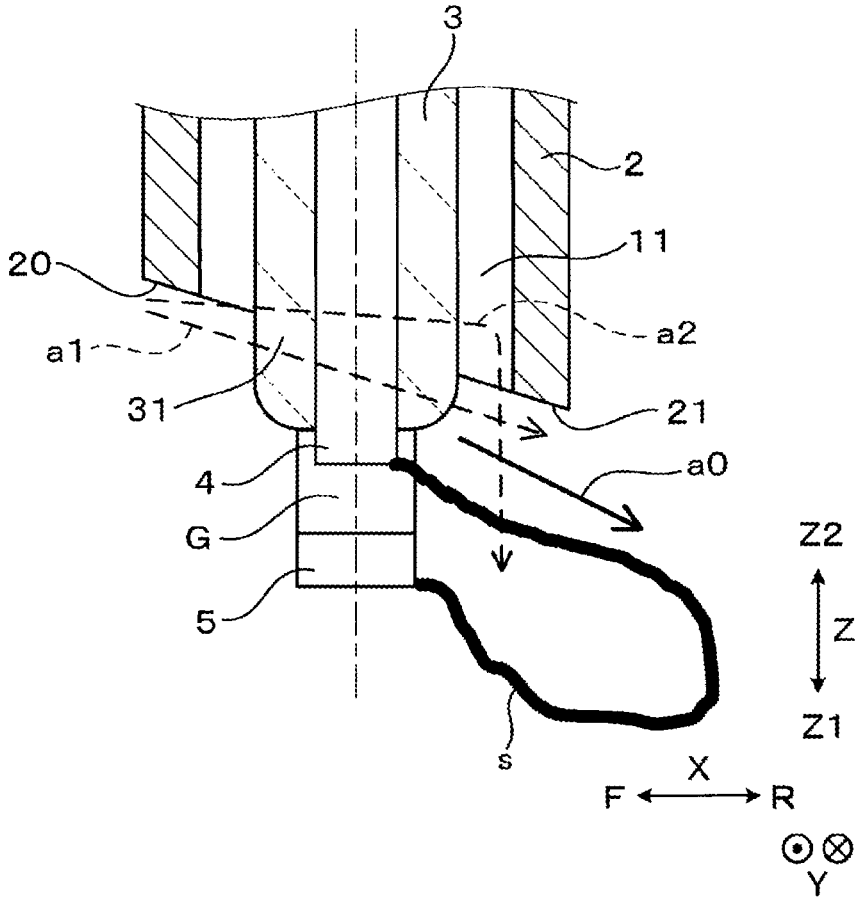
FIG. 24 is a view illustrating a state in which the discharge is stretched further toward a tip side in the fourth embodiment.

Furthermore, in the case of the present embodiment, the pocket portion 11 is formed between the housing 2 and the insulator 3 as described above. Therefore, as shown in FIG. 24, there is an air stream A1 that is guided by the tip inclined surface 21 to gradually move toward the tip end Z11, but there is also an air stream A2 that slips into the pocket portion 11 at the rear side of the insulator 3. Accordingly, the path of the air stream A2 comes to be considerably modified toward the tip end Z11 by the inner circumferential surface of the housing 2 at the rear side R of the pocket portion 11. Due to the existence of such an air stream A2, an air stream A0 as the entirety can be effectively directed toward the tip end Z11. In association with this, the discharge S is further likely to be directed toward the tip end Z11. Notably, it is considered that the degree of this effect can vary depending on a factor such as the size of the pocket portion 11.

In addition to the above-described operation and effect, the present embodiment has the same operation and effect as in the first embodiment.

The form of the spark plug is not limited to the above-described embodiments, and embodiments other than these embodiments can also be adopted.

Figure 25:
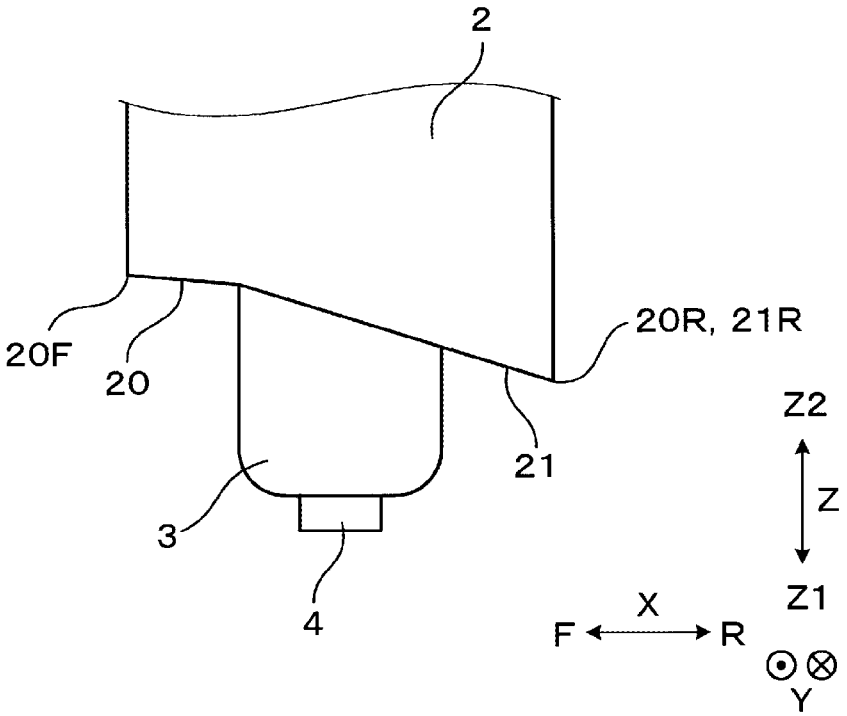
FIG. 25 is a front view of a tip portion of a spark plug in a variation embodiment.

For example, as shown in FIG. 25, the tip inclined surface 21 may not be formed on a part of the front side F on the tip surface 20 of the housing 2, and may be formed in a region from a position overlapping the insulator 3 to the rear end in the transverse direction Y.

Figure 26:
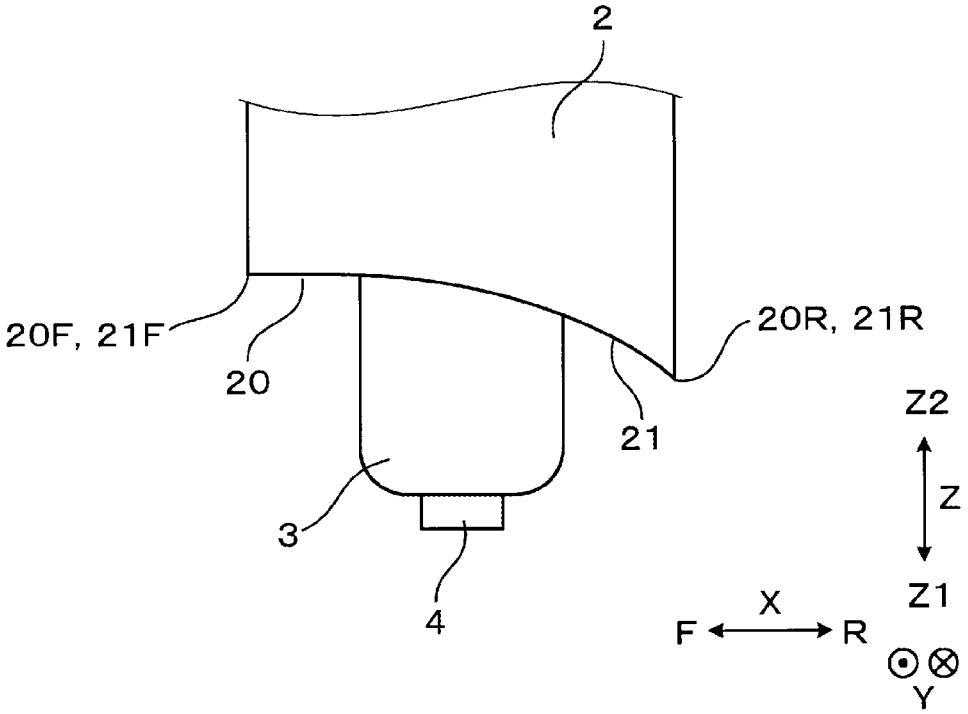
FIG. 26 is a front view of a tip portion of a spark plug in another variation embodiment.

In a modification shown in FIG. 26, the tip inclined surface 21 has a concave shape which has a convex portion at to the base end side Z2. Accordingly, the inclination angle of the tip inclined surface 21 to the specific direction X is larger toward the rear side R. Therefore, the air stream is likely to be directed toward the tip end Z11, and thus the discharge is likely to be stretched toward the tip end Z11.

Figure 27:
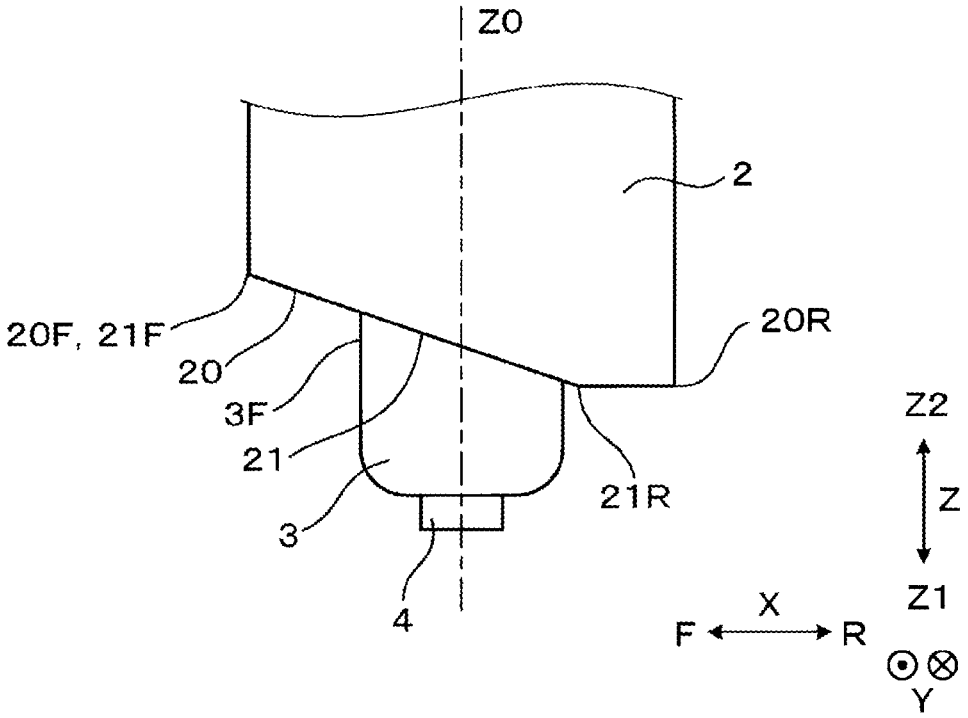
FIG. 27 is a front view of a tip portion of a spark plug in still another variation embodiment.

In a variation embodiment shown in FIG. 27, the tip inclined surface 21 is formed in a region other than a part of the rear side R of the tip surface 20.

Figure 28:
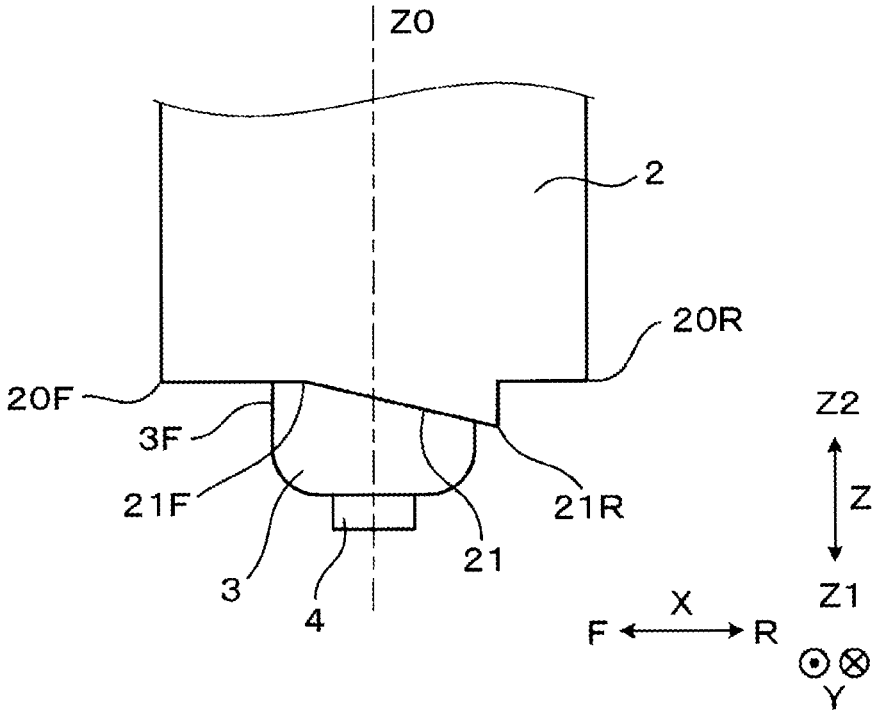
FIG. 28 is a front view of a tip portion of a spark plug in yet another variation embodiment.

In a variation embodiment shown in FIG. 28, the tip inclined surface 21 is formed in a position away from both the front end 20F and the rear end 20R of the tip surface 20.

In both the embodiment shown in FIG. 27 and the embodiment shown in FIG. 28, the rear end 21R of the tip inclined surface 21 is closer to the rear side than the front end 3F of the insulator 3. Also, the rear end 21R of the tip inclined surface 21 is closer to the rear side R than the plug central axis Z0.

FIG. 25 to FIG. 28 are all a side view of the tip portion of the spark plug when seen from the transverse direction These variation embodiments are shown as a variation embodiment of the first embodiment, but also can be applied as a variation embodiment of the fourth embodiment.

The present disclosure is not limited to the above-described embodiments, and can be applied to various embodiments within a scope that does not depart from the gist of the present disclosure.

It is understood that the present disclosure has been described in accordance with embodiments, but is not limited to the embodiments and configurations. The present disclosure encompasses various modifications or modifications within the equivalent scope. In addition, various combinations or embodiments, and furthermore other combinations and embodiments in which the various combinations or embodiments further include only one element, one or more elements, or one or less element also fall within the category or conceptual scope of the present disclosure.

What is claimed is:

1. A spark plug, having a tip end in an axial direction thereof, for an internal combustion engine , comprising:

a tubular housing;

a tubular insulator that has a tip and that is retained inside the housing;

a central electrode that has an end portion and that is retained inside the insulator, the end portion of the central electrode being exposed from the tip of the insulator toward the tip end of the spark plug; and a ground electrode that enables a discharge to be generated between the ground electrode and the central electrode, wherein the spark plug has a specific direction that is orthogonal to the axial direction of the spark plug;

the specific direction has opposing first and second sides, the first and second sides being respectively defined as a front directional side and a rear directional side;

the housing has a tip surface that has a front end in the front side of the specific direction and a rear end in the rear side of the specific direction, the tip surface having a tip inclined surface that is inclined toward the tip end of the spark plug from the front end to the rear end of the tip surface; and the tip inclined surface has a front end and a rear end in the specific direction, the insulator having a front end in the front side of the specific direction, the rear end of the tip inclined surface being located to be closer to the tip end of the spark plug than the front end of the tip surface is, and being located to be more rearward than the front end of the insulator in the rear side of the specific direction, the tip inclined surface having a length between the front end and the rear end, the insulator and the housing having a gap formed between the outer circumferential surface of the insulator and the end portion of the inner circumferential surface of the housing, the length between the front end and the rear end being longer than the gap.

2. The spark plug according to claim 1, wherein the spark plug has a central axis, and at least a part of the tip inclined surface is located to be more rearward than the central axis in the rear side of the specific direction.

3. The spark plug according to claim 2, wherein the rear end of the tip inclined surface constitutes a rear end of the tip surface of the housing in the rear side of the specific direction.

4. The spark plug according to claim 2, wherein the tip inclined surface is arranged astride a first region and a second region of the spark plug, the first region being more frontward than the central axis of the spark plug, the second region being more rearward than the central axis of the spark plug.

5. The spark plug according to claim 4, wherein the tip inclined surface is formed to extend from the front end to the rear end on the tip surface of the housing.

6. The spark plug according to claim 5, wherein the tip inclined surface is formed entirely on the tip surface of the housing.

7. The spark plug according to claim 1, wherein the spark plug has a base end opposite to the tip end, a center axis, and an outer circumferential side, and the tip surface of the housing has a radially inclined surface that is inclined toward the base end side from the outer circumferential side toward the center axis in a radial direction of the spark plug.

8. The spark plug according to claim 1, wherein the central electrode and the ground electrode face each other with a spark discharge gap disposed between the central electrode and the ground electrode.

9. The spark plug according to claim 1, wherein the insulator has an outer surface, the tip surface of the housing acts as the ground electrode, and the spark plug is configured to enable a surface discharge to be generated along a part of the outer surface of the insulator located between the central electrode and the ground electrode.

10. The spark plug according to claim 9, wherein the insulator has a rear end in the rear side of the specific direction, and the housing has a notch portion at the rear end of the insulator, the notch portion extending from the tip surface toward the base end of the spark plug.

11. An internal combustion engine comprising a combustion chamber and a spark plug that is recited in claim 1, wherein the spark plug has a front side portion in the front side of the specific direction, and the spark plug is disposed such that the front side portion of the spark plug faces an upstream side of an air stream in the combustion chamber.

12. The spark plug according to claim 1, wherein the internal combustion engine has an engine head with an inclined surface, and a degree of inclination of the tip inclined surface of the housing is equal to or greater than a degree of inclination of the inclined surface of the engine head.

* * * * *